US008960873B2

(12) United States Patent
Hara

(10) Patent No.: US 8,960,873 B2
(45) Date of Patent: Feb. 24, 2015

(54) LIQUID EJECTING APPARATUS

(71) Applicant: Seiko Epson Corporation, Tokyo (JP)

(72) Inventor: Keiji Hara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/961,280

(22) Filed: Aug. 7, 2013

(65) Prior Publication Data

US 2014/0043402 A1 Feb. 13, 2014

(30) Foreign Application Priority Data

Aug. 10, 2012 (JP) ..... 2012-178155

(51) Int. Cl.
*B41J 2/175* (2006.01)
*B41J 29/02* (2006.01)
*B41J 29/13* (2006.01)

(52) U.S. Cl.
CPC ..... *B41J 2/175* (2013.01); *B41J 2/17513* (2013.01); *B41J 2/1752* (2013.01); *B41J 2/17553* (2013.01); *B41J 29/02* (2013.01); *B41J 29/13* (2013.01)
USPC ..... 347/86

(58) Field of Classification Search
USPC ..... 347/84–86
See application file for complete search history.

(56) References Cited

U.S. PATENT DOCUMENTS 6,152,555 A 11/2000 Nozawa et al.
7,399,070 B2 * 7/2008 Nakamura et al. ..... 347/84
2012/0038719 A1 * 2/2012 Shimizu et al. ..... 347/86

FOREIGN PATENT DOCUMENTS

JP 10-286972 10/1998
JP 2013-010294 1/2013

* cited by examiner

*Primary Examiner* — Stephen Meier
*Assistant Examiner* — Sharon A Polk
(74) *Attorney, Agent, or Firm* — Workman Nydegger

(57) ABSTRACT

A liquid ejecting apparatus includes a liquid ejecting head, a mounting mechanism including a downstream flow path, a cartridge including an upstream flow path to be communicably connected to the downstream flow path when the cartridge is attached to the mounting mechanism and an annular projection, and configured to be mounted on the mounting mechanism by being made to pivot, a carriage that reciprocates in a predetermined stroke region carrying thereon the liquid ejecting head and the mounting mechanism, a liquid supply tube connecting between a liquid tank located outside the stroke region and the upstream flow path, and an elastic member of an annular shape having a larger outer diameter than that of the annular projection and a smaller inner diameter than that of the annular projection and disposed to surround a liquid introduction path, the elastic member including an abutment portion.

14 Claims, 8 Drawing Sheets

LIQUID EJECTING APPARATUS

BACKGROUND

1. Technical Field

The present invention relates to a liquid ejecting apparatus that ejects a liquid supplied from a liquid chamber.

2. Related Art

Liquid ejecting apparatuses thus far developed include an ink jet printer (hereinafter, simply "printer") that ejects ink, an example of the liquid, onto a recording medium such as a paper sheet thereby performing a recording operation. Such printers generally include a holder on which an ink tank serving as a supply source of the ink is mounted. Some of the holders include a supply tube connected to an outlet of the ink tank, and an annular elastic member disposed to surround the supply tube so as to seal the joint portion between the outlet and the supply tube.

An example of the elastic member for sealing the joint portion in the liquid flow path is an O-ring having a circular cross-sectional shape. However, the O-ring generates considerably large counterforce upon being elastically deformed, and hence requires large force for installing the ink tank.

To minimize such a drawback, a structure has been proposed in which a projection is formed on the ink tank, so that the ink tank is engaged with the holder via the projection and then made to pivot about the projection, to mount the ink tank. In addition, the elastic member includes a projection formed along the periphery thereof to which the ink tank is made to abut, so that the counterforce originating from the elastic deformation of the elastic member is reduced (for example, JP-A-10-286972).

However, in the case where the ink tank is brought into contact with the elastic member via the peripheral projection as above, a decrease in contact area therebetween leads to a degraded sealing effect. In particular, when the ink tank is made to pivot in the mounting process the peripheral projection may collapse in the pivoting direction. In such a case, the elastic member may fail to provide a sufficient sealing effect, compared with the case where the ink tank is mounted in a linear motion from the side of the outlet toward the supply tube.

Further, the mentioned drawback is incidental not only to such printers that include the holder on which the ink tank can be mounted, but broadly to liquid ejecting apparatuses having an elastic member for sealing a joint portion in a liquid flow path.

SUMMARY

An advantage of some aspects of the invention is that a liquid ejecting apparatus is provided that allows the liquid flow path to be connected with a smaller force, and is yet capable of securing a sufficient sealing effect at a joint portion in the liquid flow path.

In an aspect, the invention provides a liquid ejecting apparatus including a liquid ejecting head that ejects a liquid, a carriage that reciprocates in a predetermined stroke region, a liquid tank provided outside of the stroke region, a mounting mechanism including a downstream flow path having a downstream end communicating with the liquid ejecting head, an object to be mounted on the mounting mechanism, the object to be mounted including an annular projection formed so as to surround, when the object to be mounted is attached to the mounting mechanism, a liquid outlet to be communicably connected to the downstream flow path, a liquid supply tube connected to the liquid tank, and an elastic member disposed to surround a liquid introduction path corresponding to an upstream end of the downstream flow path, the elastic member including an abutment portion.

The mentioned configuration allows the object to be mounted to be attached to the mounting mechanism by being made to pivot, thereby allowing the upstream flow path and the downstream flow path to be connected to each other with a reduced force.

In the foregoing liquid ejecting apparatus, the elastic member may have an annular shape with an outer diameter larger than an outer diameter of the annular projection and an inner diameter smaller than an inner diameter of the annular projection, and a first width of the abutment portion corresponding to a distance between an outer periphery and an inner periphery in a first direction may be larger than a second width corresponding to a distance between an outer periphery and an inner periphery in a second direction intersecting the first direction.

In this case, since the first width of the abutment portion is larger than the second width, the elastic member can securely seal the portion around the liquid introduction path, even when the annular projection is displaced in the first direction by the pivotal motion of the object to be mounted when entering in contact with the abutment portion. Such a configuration allows, therefore, a sufficient sealing effect to be secured at the joint portion in the liquid flow path, while allowing the liquid flow path to be connected with a reduced force.

In the foregoing liquid ejecting apparatus, the mounting mechanism may include an engaging portion extending in the first direction, and the object to be mounted may include a mating portion to be engaged with the engaging portion, so as to be mounted on the mounting mechanism by being made to pivot about the mating portion engaged with the engaging portion.

With the mentioned configuration, the object to be mounted is attached to the mounting mechanism by being made to pivot about the mating portion engaged with the engaging portion of the mounting mechanism. Therefore, the upstream flow path and the downstream flow path can be connected to each other with a reduced force.

Preferably, a width of the abutment portion in the first direction may be larger than a width thereof in the second direction.

In this case, since the width of the abutment portion in the first direction is larger than the width in the second direction, the elastic member can securely seal the portion around the liquid introduction path, even when the annular projection is displaced in the first direction by the pivotal motion of the object to be mounted when entering in contact with the abutment portion.

Preferably, the elastic member may include a pair of support walls respectively extending from the inner periphery and the outer periphery of the abutment portion in a third direction intersecting both the first direction and the second direction.

With the mentioned configuration, the abutment portion is flexurally deformed in the third direction when the annular projection is pressed against the abutment portion, therefore the elastic member can securely seal the portion around the liquid introduction path, while suppressing the counterforce originating from the elastic deformation of the abutment portion. In addition, the space defined by the abutment portion and the support walls is depressurized when air is squeezed out of that space by the flexural deformation of the abutment portion. Accordingly, the elastic member is adsorbed to the mounting mechanism, which prevents the elastic member from coming off from the mounting mechanism when the mounted object is removed.

In the elastic member, preferably, a length of the abutment portion in the third direction may be shorter than a length of the support wall in the third direction.

Making the abutment portion of the elastic member shorter than the support wall in the third direction allows the counterforce originating from the elastic deformation to be reduced. At the same time, making the support wall of the elastic member longer than the abutment portion in the third direction allows a space for flexural deformation of the abutment portion in the third direction to be secured.

Preferably, the elastic member may have the midpoint in the first direction coinciding with the midpoint in the second direction when viewed in the third direction intersecting both the first direction and the second direction, and have a line-symmetrical shape with respect to a first axis extending in the first direction through the midpoint, and with respect to a second axis extending in the second direction through the midpoint.

In this case, since the elastic member has a symmetrical shape both in the first direction and the second direction, the orientation of the elastic member in the first direction or the second direction is not limited when the elastic member is attached to the mounting mechanism. Such a configuration facilitates the elastic member to be set in place, compared with the case where the mounting orientation is limited in the first direction or the second direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
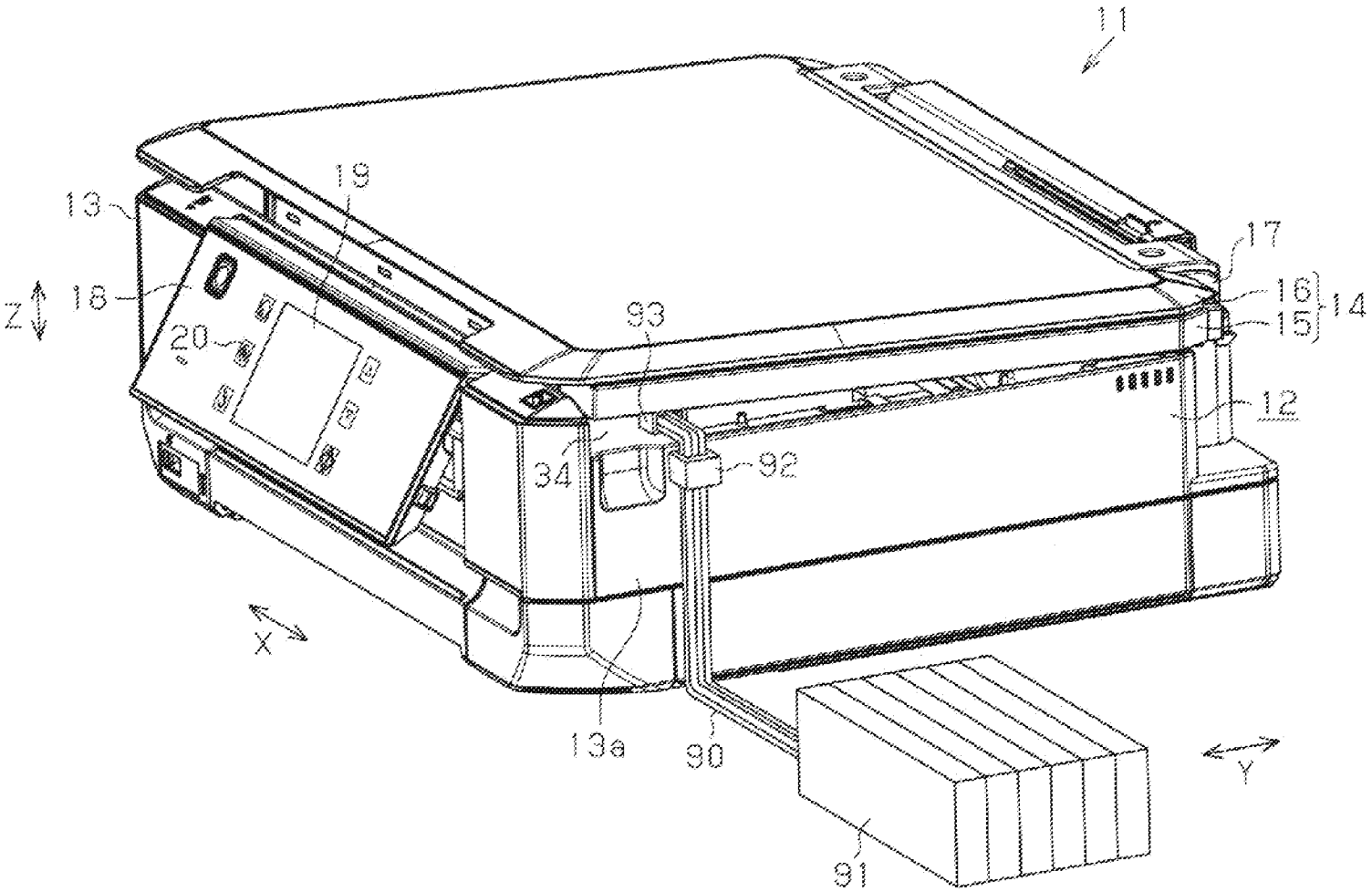
FIG. 1 is a perspective view showing a multifunction printer including a liquid ejecting apparatus according to an embodiment of the invention.

Hereafter, a liquid ejecting apparatus according to an embodiment of the invention will be described referring to the drawings.

As shown in FIG. 1, a multifunction printer 11 includes a liquid ejecting apparatus 12, and a scanner unit 14 superposed thereon in the anti-gravity direction and coupled to a main casing 13 of the liquid ejecting apparatus 12. In the following description, the anti-gravity direction will be referred to as upward direction, the gravity direction will be referred to as a downward direction, and a third direction along the upward and downward direction will be indicated as up-down direction Z in the drawings.

The scanner unit 14 includes a scanner main body 15 coupled to the liquid ejecting apparatus 12, and a cover 16 provided on the upper side of the scanner main body 15. The scanner unit 14 can be opened and closed with respect to the main casing 13 via a pivotal mechanism 17 such as a hinge provided at an end portion of the scanner unit 14.

In the following description, the side of the multifunction printer 11 on which the pivotal mechanism 17 is located will be referred to as rear side, and the opposite side will be referred to as front side. A first direction along the forward or backward direction will be indicated as front-back direction Y in the drawings. Further, a second direction intersecting (in this embodiment, orthogonal) both of the front-back direction Y and the up-down direction Z will be indicated as main scanning direction X in the drawings. The scanner main body 15 can be opened by making the front edge thereof pivot upward.

A pivotable operation panel 18 is provided on the front face of the main casing 13. A display unit (for example, an LCD) 19 that displays a menu screen and so forth and operating buttons 20 are located on the front face of the operation panel 18.

A liquid tank 91 provided outside of the main casing 13 is connected to the liquid ejecting apparatus 12 through a liquid supply tube 90. The liquid supply tube 90 is fixed with a fastener 92 to a sidewall 13*a* extending in the front-back direction Y and the up-down direction Z on the main casing 13. In addition, a duct 93 is provided between the main casing 13 and the scanner main body 15, for passing the liquid supply tube 90 through the duct 93.

Figure 2:
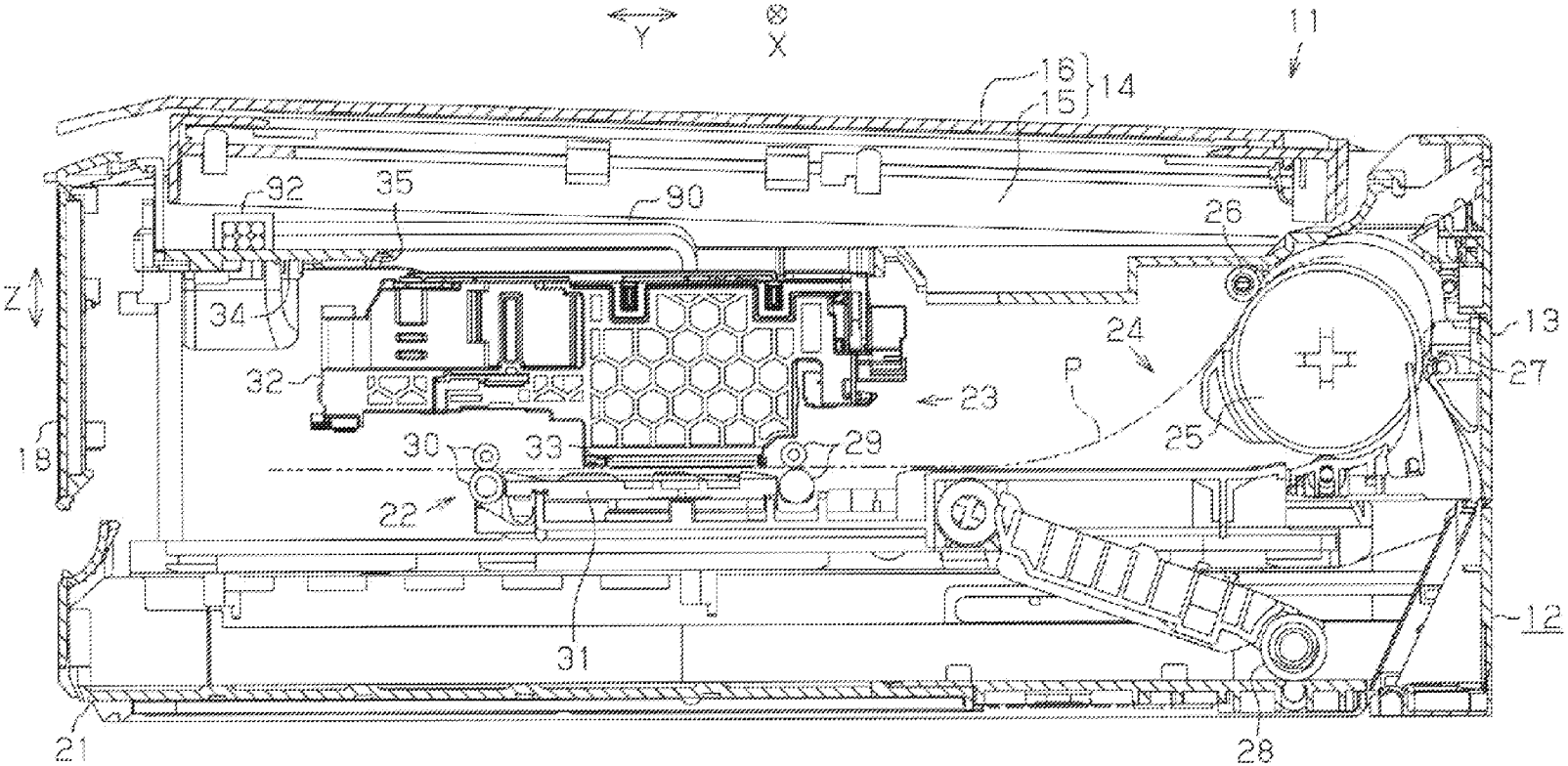
FIG. 2 is a cross-sectional view of the multifunction printer.

As shown in FIG. 2, a sheet cassette 21 that carries a plurality of paper sheets P is removably mounted on the inner bottom portion of the main casing 13. In addition, a transport mechanism 22 configured to transport the paper sheet P, and a recording unit 23 that performs a recording operation onto the paper sheet P transported by the transport mechanism 22 are installed inside of the main casing 13.

The transport mechanism 22 includes a feeding mechanism 24 that feeds the paper sheets P placed in the sheet cassette 21 one by one to the recording unit 23. The feeding mechanism 24 includes a feed drive roller 25, a feed slave roller 26 that follows the rotation of the feed drive roller 25 with the paper sheet P pinched therebetween, a splitting roller 27, and a pickup roller 28.

The transport mechanism 22 also includes a transport roller pair 29 that transports the paper sheet P delivered from the feeding mechanism 24 to the recording unit 23, and a discharge roller pair 30 that discharges the paper sheet P that has undergone the recording operation by the recording unit 23. Further, a support member 31 that supports the paper sheet P is provided between the transport roller pair 29 and the discharge roller pair 30 in the front-back direction Y along the transport direction.

A carriage 32 included in the recording unit 23 is installed above the support member 31 inside of the main casing 13, so as to reciprocate in the main scanning direction X. A liquid ejecting head 33 that ejects ink, exemplifying the liquid in the invention, is mounted on the lower face of the carriage 32. Thus, when the liquid ejecting head 33 ejects ink droplets onto the paper sheet P transported by the transport mechanism 22 to the position on the support member 31, the recording operation is performed.

The upper wall 34 of the main casing 13 includes an opening 35 located above the stroke region of the carriage 32 along the main scanning direction X and having a shape corresponding to the stroke region. When the scanner unit 14 is opened, the upper side of the carriage 32 is exposed through the opening 35 formed in the upper wall 34 of the main casing 13.

Figure 3:
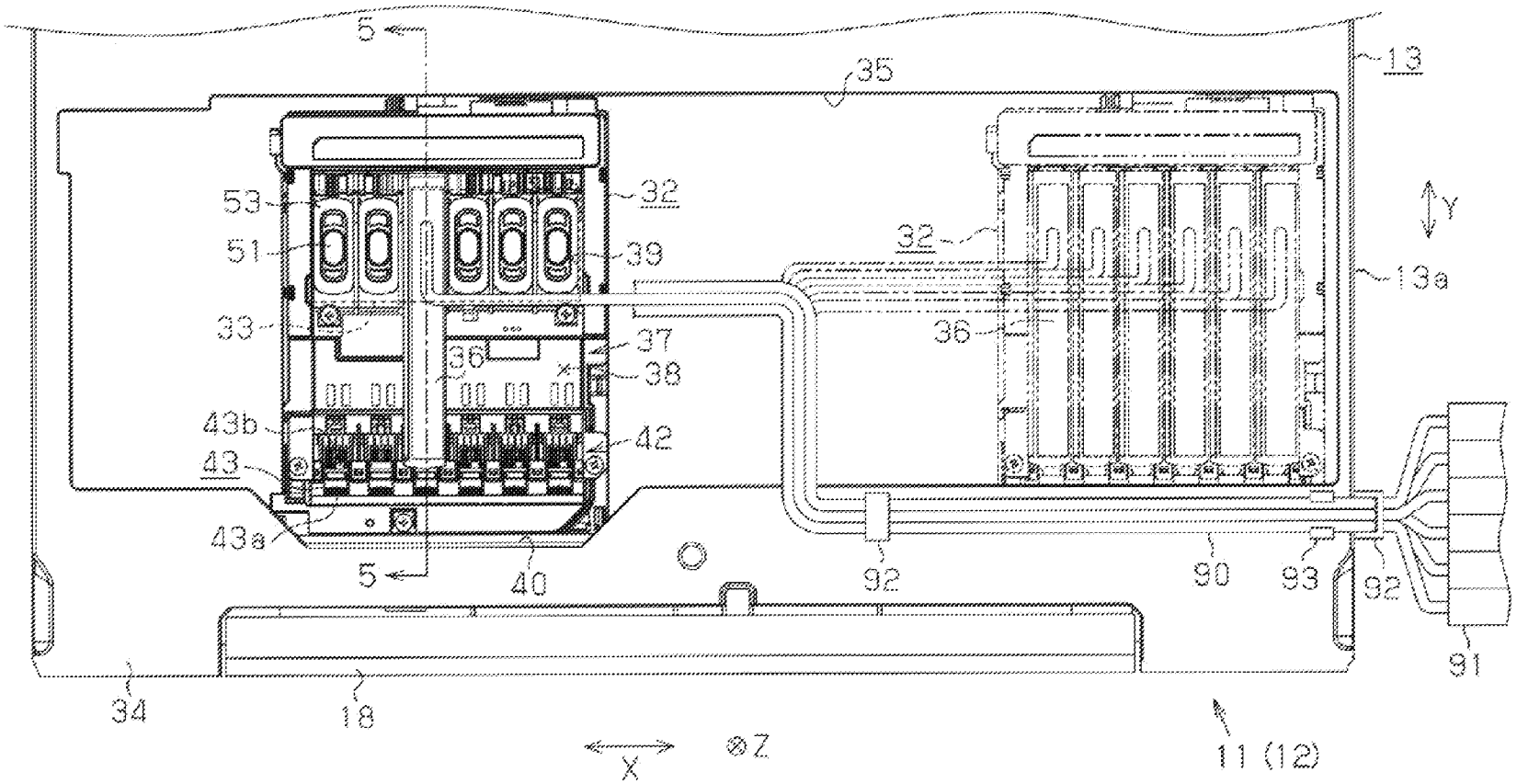
FIG. 3 is a partial plan view of a main casing.

As shown in FIG. 3, a mounting mechanism 37 is installed on the carriage 32. On the mounting mechanism 37, a cartridge 36 storing therein the ink, exemplifying the object to be mounted in the invention, is to be removably mounted. The mounting mechanism 37 includes a chamber 38 in which the cartridge 36 can be accommodated. Here, the chamber 38 is configured to accommodate a plurality (in this embodiment, six pieces) of cartridges 36 aligned in the main scanning direction X.

The chamber 38 includes a cartridge inlet 39 which is an opening directed upward. Here, the mounting mechanism 37 is not provided with a member that covers the cartridge inlet 39. Therefore, the cartridge 36 can be introduced into the chamber 38 through the cartridge inlet 39, because the upper side of the carriage 32 is exposed.

The opening 35 includes a cutaway portion 40 formed in the vicinity of an end portion (on the left in FIG. 3) of the front side extending in the main scanning direction X. The position of the cutaway portion 40 corresponds to a mounting/removing position where the carriage 32 is located when the cartridge 36 is mounted or removed.

The liquid supply tube 90 is introduced into the main casing 13 from outside thereof, through the opening 35 formed in the upper wall 34. In other words, the cartridge 36 serves as an intermediate adapter for supplying the ink stored in the liquid tank 91, which is an external tank, to the liquid ejecting head 33.

The liquid supply tube 90 passed through the duct 93 is routed on the upper face of the upper wall 34 along the front side of the opening 35 and drawn into inside thereof, and then connected to the cartridge 36. Thus, the liquid supply tube 90 connects between the liquid tank 91 provided outside of the stroke region of the carriage 32 and an upstream flow path 95. The liquid supply tube 90 is fixed to the upper wall 34 with the fastener 92. Further, a plurality of the liquid supply tubes 90 and liquid tanks 91 are provided according to the number of the cartridges 36.

Hereunder, a configuration of the mounting mechanism 37 will be described in further details.

The mounting mechanism 37 includes a holding mechanism 42 that retains the cartridge 36 set in the chamber 38.

The holding mechanism 42 includes an operating lever 43 pivotably attached to the front side of the chamber 38. The operating lever 43 includes a manipulating portion 43*a* to be subjected to an external operating force and provided in an upper region of the pivotal center, and an engaging portion 43*b* to be engaged with the cartridge 36 and provided in a lower region of the pivotal center.

The cutaway portion 40 in the opening 35 allows the manipulating portion 43*a* provided in the mounting mechanism 37 for receiving an external operating force to be exposed, at the mounting/removing position in the main scanning direction where the cartridge 36 is to be mounted or removed. In contrast, the main casing 13 serves to cover the manipulating portion 43*a* in the region other than the mounting/removing position. Accordingly, when the carriage 32 is located at the mounting/removing position as indicated by solid lines in FIG. 3, the manipulating portion 43*a* of the operating lever 43 is exposed through the cutaway portion 40, and hence can be reached for operation. On the other hand, when the carriage 32 is deviated from the mounting/removing position as indicated by dash-dot-dot lines in FIG. 3, the manipulating portion 43*a* of the operating lever 43 is hidden below the upper wall 34 of the main casing 13 and hence cannot be reached.

Figure 4:
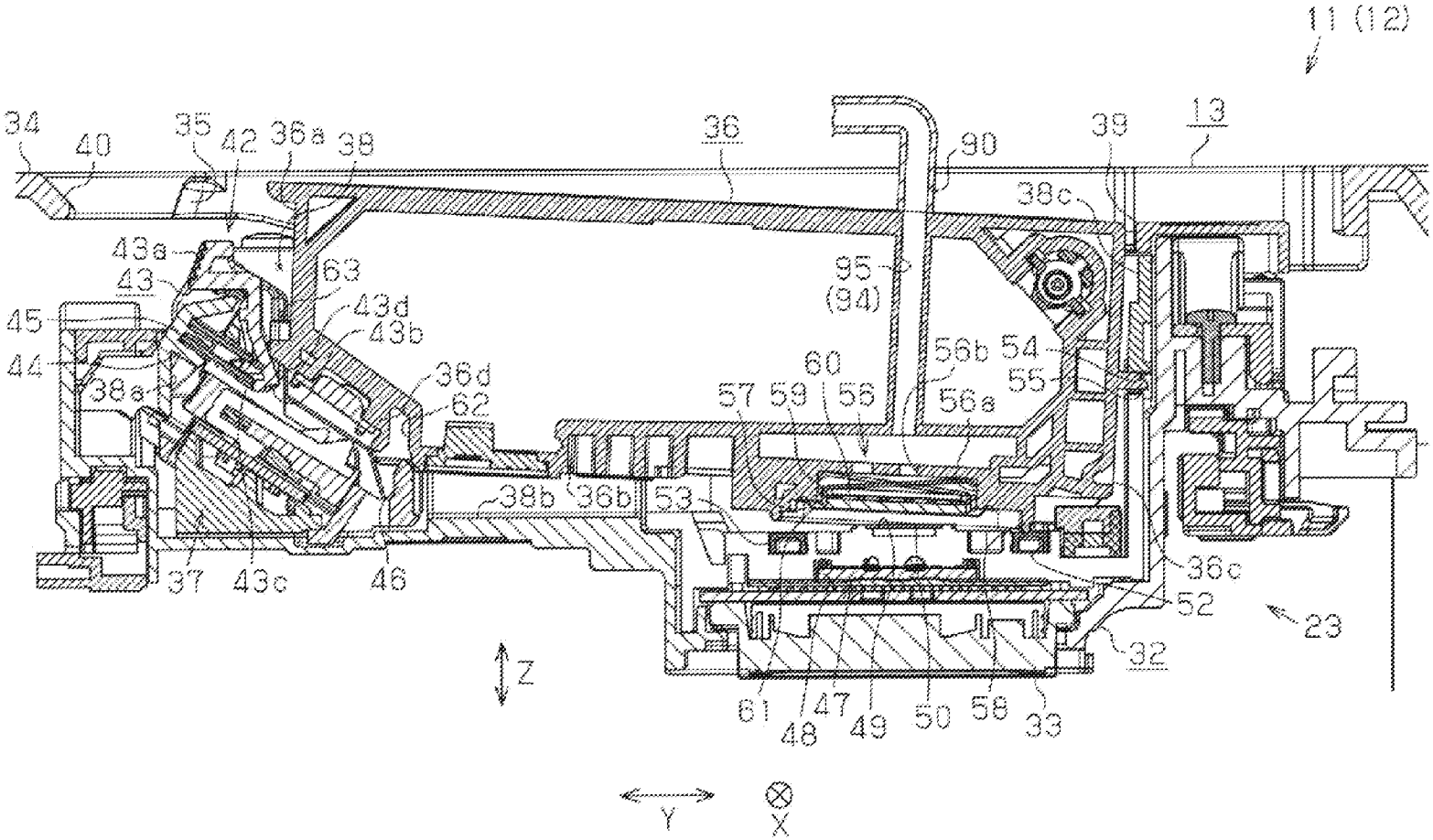
FIG. 4 is a cross-sectional view of a mounting mechanism with a mounted object set in an engaging position.

As shown in FIG. 4, the operating lever 43 includes the engaging portion 43*b* formed on the rear side of the lower portion facing the inside of the chamber 38 (on the right in FIG. 4), and a spring engagement portion 43*c* formed on the front side (on the left in FIG. 4). The operating lever 43 also includes a sloped portion 43*d* formed in the portion facing the inside of the chamber 38 and inclined inwardly of the chamber 38 from the pivotal center toward the engaging portion 43*b*.

The chamber 38 includes a spring hook portion 44 projecting obliquely downward from a position on the inner front wall 38*a* corresponding to the cartridge inlet 39 in the up-down direction Z. Further, a coil spring 45 is provided between the spring hook portion 44 and the spring engagement portion 43*c* of the operating lever 43, so as to bias the lower end portion of the operating lever 43 toward an inner portion of the chamber 38.

A stopper pin 46 projecting upward is provided in the vicinity of the front end portion of the inner bottom portion 38*b* of the chamber 38. In addition, a liquid introduction path 47 to be connected to the cartridge 36 when the cartridge 36 is set in the chamber 38 is provided on the inner bottom portion 38*b* in the vicinity of the rear end portion thereof.

The liquid introduction path 47 includes a liquid introduction path 49 open upward, which is the upstream end of a downstream flow path 48 having the downstream end communicating with the liquid ejecting head 33. In addition, a downstream filter 50 is attached to the liquid introduction path 47 so as to cover the liquid introduction path 49.

The liquid introduction path 47 includes an annular groove 52 formed so as to surround the liquid introduction path 49. In addition, an annular elastic member 53 is fitted in the groove 52 so as to surround the liquid introduction path 49. Further, an engaging portion 54 is provided, in a form of a recess directed backward, at a generally central position on the inner rear wall 38*c* of the chamber 38 in the up-down direction Z.

Hereunder, the cartridge 36 will be described in further details.

The cartridge 36 includes a liquid supply path 94 having the upstream end connected to the downstream end of the liquid supply tube 90.

The cartridge 36 has a generally rectangular block shape, and is mounted on the mounting mechanism 37 such that the longitudinal direction of the cartridge 36 is aligned with the front-back direction Y. Here, the face of the cartridge 36 opposing the inner front wall 38*a* when the cartridge 36 is placed in the chamber 38 will be referred to as front face 36*a*, the face opposing the inner bottom portion 38*b* will be referred to as bottom face 36*b*, and the face opposing the inner rear wall 38*c* will be referred to as rear face 36*c*. The cartridge 36 includes a sloped face 36*d* located between the front face 36*a* and the bottom face 36*b*.

The cartridge 36 includes a mating portion 55 projecting from the rear face 36*c*, so as to be fitted in the engaging portion 54. In addition, a liquid supply unit 56 is provided in the bottom face 36*b* of the cartridge 36, at a position in the vicinity of the rear end portion thereof.

The liquid supply unit 56 includes a supply port 56*a*, the opening of which serves as a liquid outlet 57, and an annular projection 58 projecting from the bottom face 36*b* of the cartridge 36 so as to surround the liquid outlet 57. The liquid supply unit 56 also includes a communication hole 56*b* that allows communication between inside of the supply port 56*a* and the downstream end of the liquid supply path 94. Thus, the liquid supply path 94, the communication hole 56*b* and the supply port 56*a* constitute the upstream flow path 95. The liquid outlet 57 corresponds to the downstream end of the upstream flow path 95.

In the supply port 56*a*, a spring 59 is provided on the side of the communication hole 56*b* and a porous material 60 is provided on the side of the liquid outlet 57. The porous material 60 includes a multitude of pores through which the ink can flow. In addition, an upstream filter 61 is attached to the liquid supply unit 56, so as to cover the liquid outlet 57.

A positioning hole 62 is provided in the sloped face 36*d* of the cartridge 36 at a position on the side of the bottom face 36*b*, so that the stopper pin 46 can be fitted in the positioning hole 62. Further, an engaging protrusion 63 protruding in the front direction, i.e., toward the operating lever 43, is provided on the sloped face 36*d* of the cartridge 36 at a position on the side of the front face 36*a*.

Hereunder, description will be given on a process of mounting and removing the cartridge 36 on and from the mounting mechanism 37.

To mount the cartridge 36 on the mounting mechanism 37, first the carriage 32 is brought to the mounting/removing position. At this stage, the manipulating portion 43*a* of the operating lever 43 provided in the mounting mechanism 37 is exposed through the cutaway portion 40 in the opening 35.

Before the cartridge 36 is mounted, the operating lever 43 has its lower end portion sticking out into the chamber 38, because of the biasing force of the coil spring 45. When the cartridge 36 is introduced into the chamber 38 and the mating portion 55 projecting from the rear face 36*c* of the cartridge 36 is fitted in the engaging portion 54, the front edge of the cartridge 36 is made to pivot about the mating portion 55 by the self-weight of the cartridge 36, so that the engaging protrusion 63 is brought into contact with the engaging portion 43*b* of the operating lever 43. At this stage, the cartridge 36 is at the engaged position in which the upper front end portion of the cartridge 36 is exposed upward from the cartridge inlet 39, as shown in FIG. 4.

Then upon pressing downward the upper front end portion of the cartridge 36 exposed from the cartridge inlet 39, the cartridge 36 is made to pivot counterclockwise in FIG. 4 about the mating portion 55 engaged with the engaging portion 54. Then the engaging protrusion 63 of the cartridge 36 presses the sloped portion 43*d* of the operating lever 43, so that the operating lever 43 is made to pivot clockwise in FIG. 4, against the biasing force of the coil spring 45.

At the same time, the cartridge 36 being made to pivot is subjected to a counterforce corresponding to the restoring force of the elastic member 53 being elastically deformed. Further, when the stopper pin 46 is fitted in the positioning hole 62 of the cartridge 36, the cartridge 36 is restricted from moving in the main scanning direction X.

Figure 5:
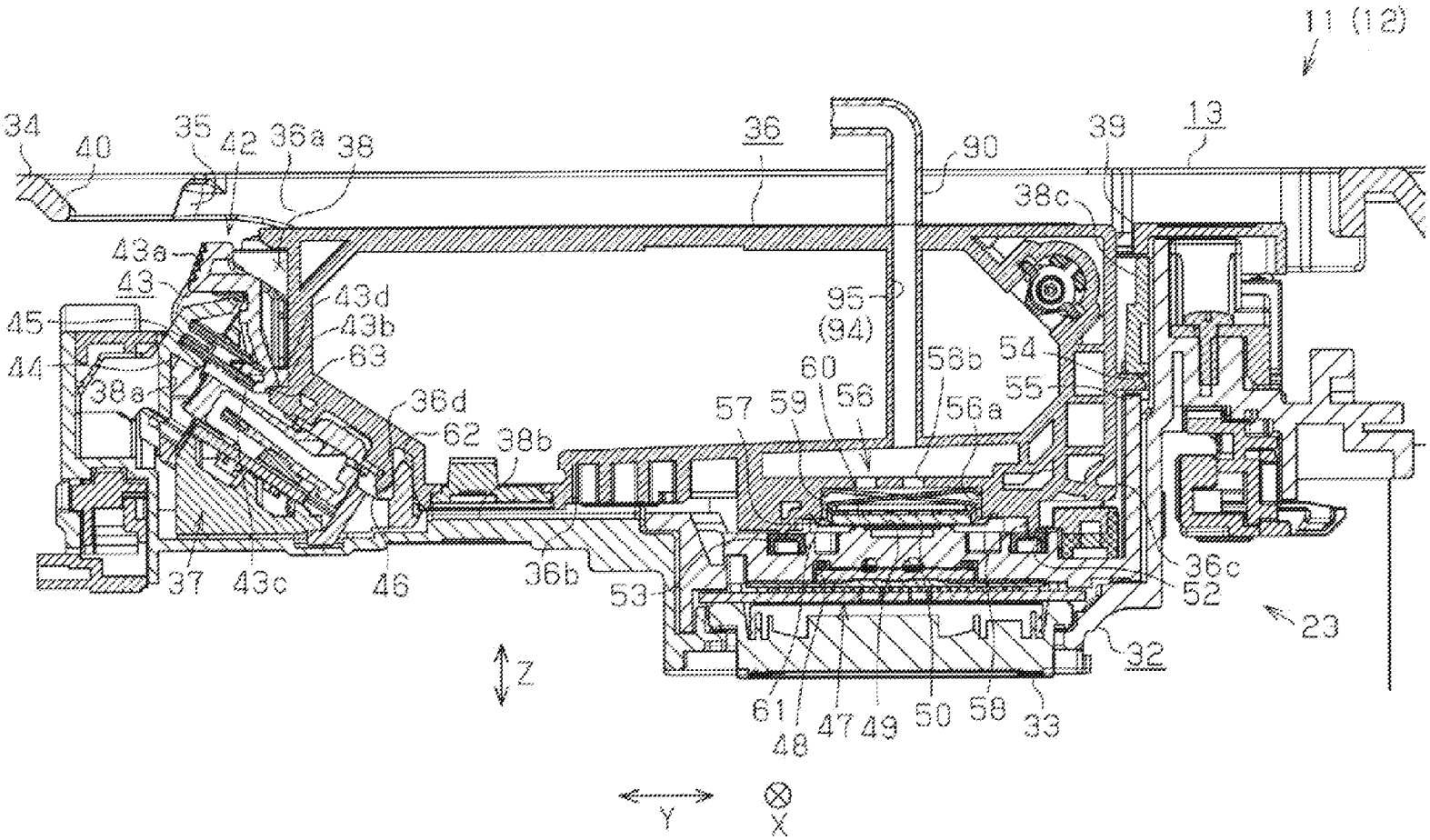
FIG. 5 is a cross-sectional view taken along a line V-V in FIG. 3.

When the cartridge 36 is introduced into the chamber 38 against the counterforce of the elastic member 53, the engaging protrusion 63 of the cartridge 36 is displaced to a position under the operating lever 43. Then the operating lever 43 returns to the initial position owing to the biasing force of the coil spring 45, so that the engaging protrusion 63 of the cartridge 36 is blocked by the engaging portion 43*b* of the operating lever 43 as shown in FIG. 5.

When the cartridge 36 is accommodated in the chamber 38 as described above, the upstream flow path 95 is communicably connected to the downstream flow path 48 in the mounting mechanism 37, and the mounting of the cartridge 36 on the mounting mechanism 37 is completed. In the subsequent description, the position of the cartridge 36 completely set on the mounting mechanism 37 as shown in FIG. 5 will be referred to as mounted position.

Hereunder, the elastic member 53 and the liquid supply unit 56 will be described in further details.

Figure 6:
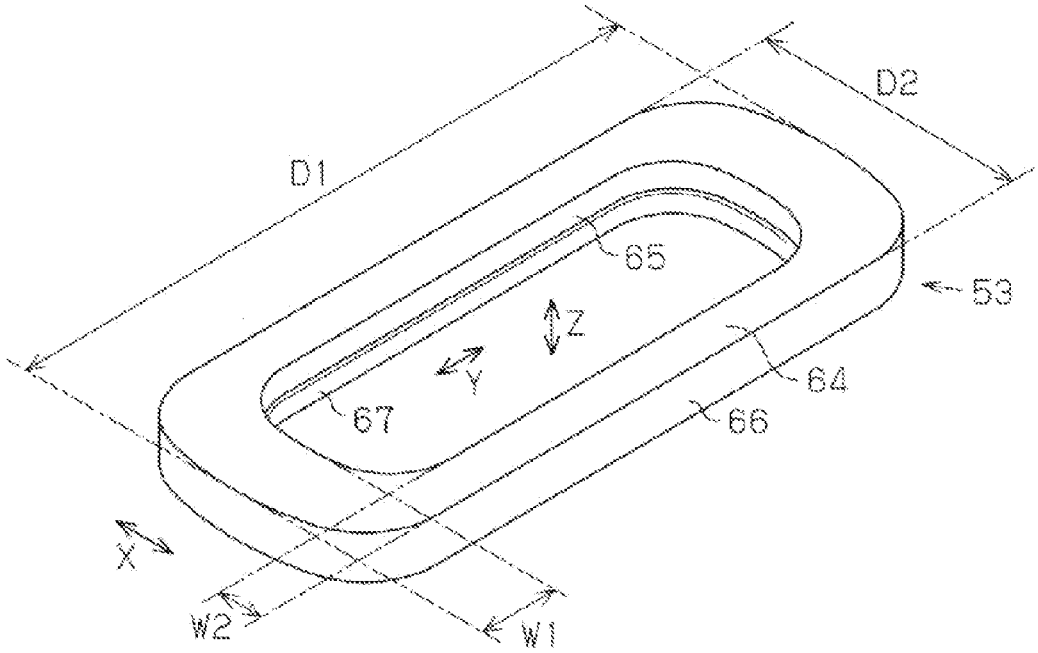
FIG. 6 is a perspective view showing an elastic member.

As shown in FIG. 6, the elastic member 53 includes an annular abutment portion 64, and a pair of support walls 65, 66 extending in the up-down direction Z from the inner periphery and the outer periphery of the abutment portion 64, respectively. In addition, the support wall 65 extending from the inner periphery of the abutment portion 64 includes a press-contact portion 67 extending from the lower end portion of the support wall 65.

In the abutment portion 64 of the elastic member 53, a first width W1 corresponding to the distance between the outer periphery and the inner periphery in the front-back direction Y is wider than a second width W2 corresponding to the distance between the outer periphery and the inner periphery in the main scanning direction X (W1>W2). In addition, the width D1 of the abutment portion 64 in the front-back direction Y is wider than the width D2 in the main scanning direction X (D1>D2).

Figure 7:
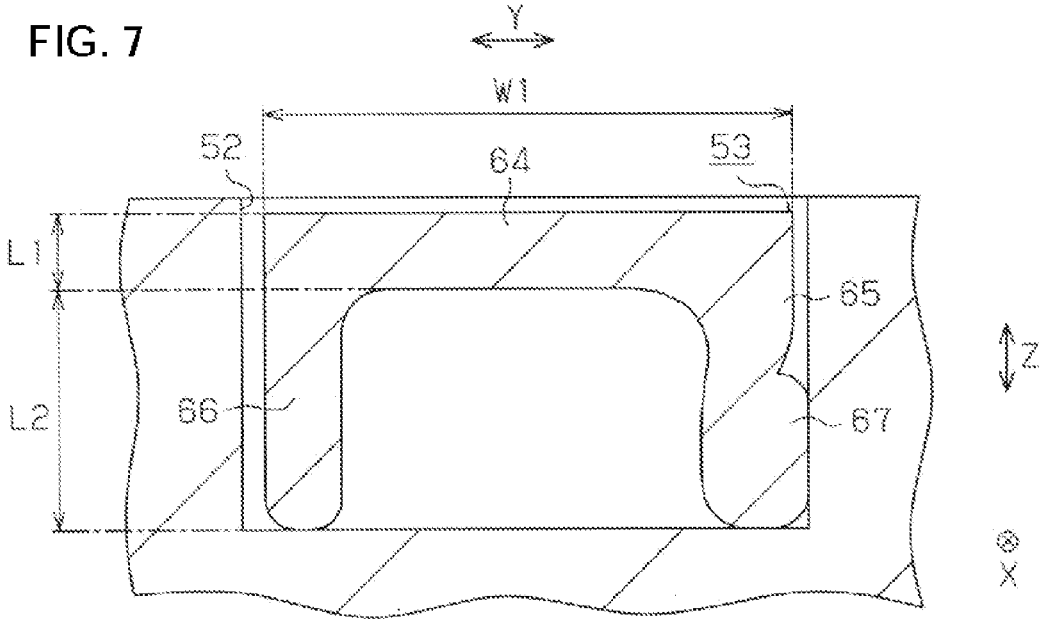
FIG. 7 is a cross-sectional view of the elastic member fitted in a recess.

As shown in FIG. 7, the length L1 of the abutment portion 64 of the elastic member 53 in the up-down direction Z is shorter than the length L2 of the support walls 65, 66 in the up-down direction Z (L1<L2). Accordingly, when the elastic member 53 is fitted in the groove 52, the press-contact portion 67 and the support wall 65 are elastically deformed so that the press-contact portion 67 is pressed against the inner wall of the groove 52.

Figure 8:
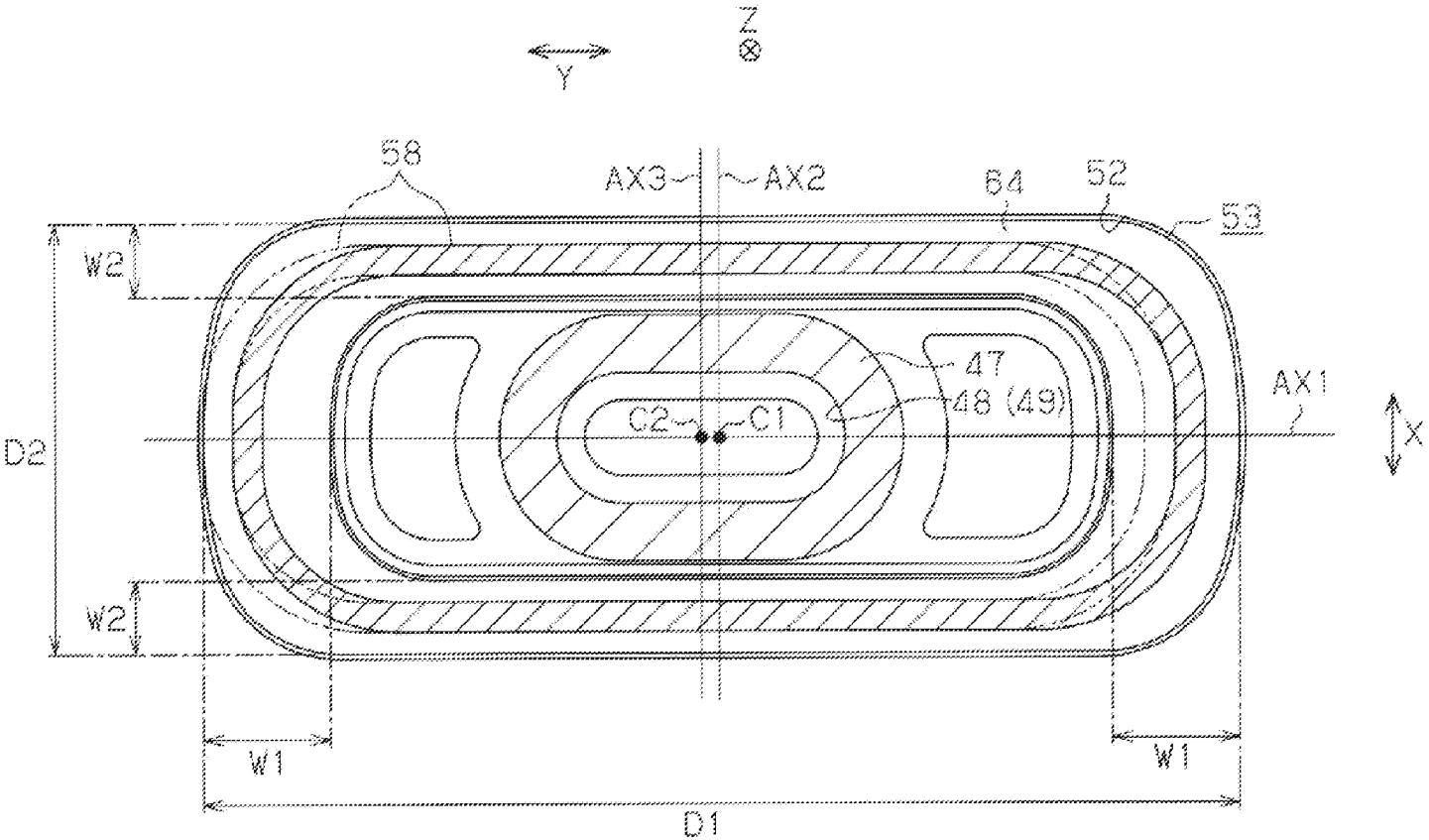
FIG. 8 is a cross-sectional view of the elastic member for explaining the structure and working thereof.

As shown in FIG. 8, the abutment portion 64 of the elastic member 53 is of an annular shape having an outer diameter larger than the outer diameter of the annular projection 58, and an inner diameter smaller than the inner diameter of the annular projection 58, and disposed to surround the liquid introduction path 49. In addition, the midpoint of the abutment portion 64 of the elastic member 53 in the front-back direction Y coincides with the midpoint in the main scanning direction X. Further, the elastic member 53 has a line-symmetrical shape with respect to a first axis AX1 extending in the front-back direction Y through the center C1 in both of the front-back direction Y and the main scanning direction X, as well as with respect to a second axis AX2 extending in the main scanning direction X through the center C1.

On the other hand, a width of the liquid introduction path 49 in the liquid introduction path 47 in the front-back direction Y is larger than a width in the main scanning direction X, and the midpoint in the front-back direction Y coincides with the midpoint in the main scanning direction X, when viewed from above. The liquid introduction path 49 has a line-symmetrical shape with respect to a first axis AX1 extending in the front-back direction Y through the center C2 in both of the front-back direction Y and the main scanning direction X, as well as with respect to a third axis AX3 extending in the main scanning direction X through the center C2. Here, the center C2 of the liquid introduction path 47 is slightly shifted forward from the center C1 of the elastic member 53.

Figure 9:
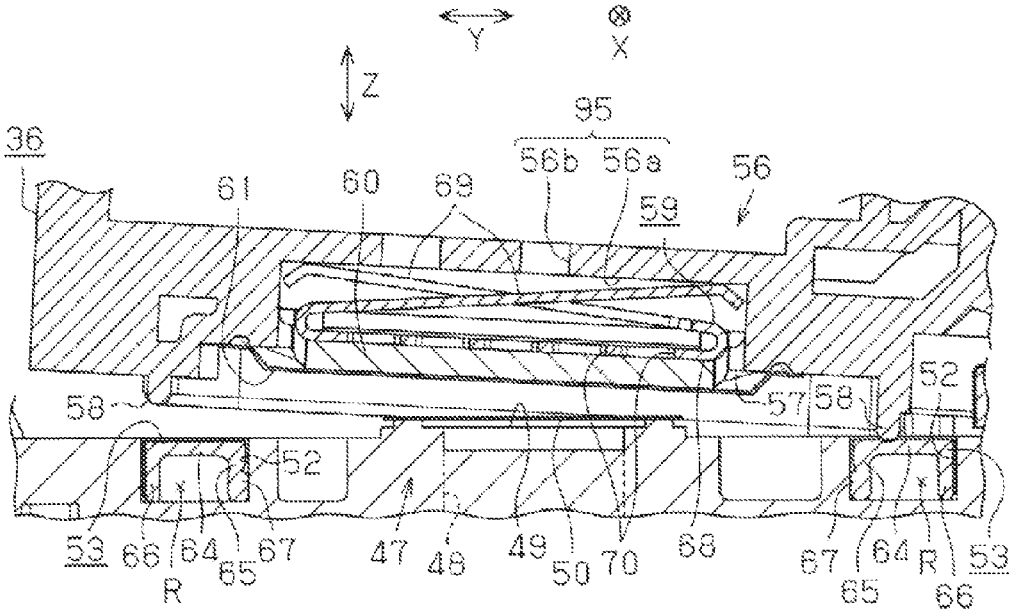
FIG. 9 is an enlarged cross-sectional view of a portion shown in FIG. 4.

As shown in FIG. 9, the spring 59 in the liquid supply unit 56 includes a plate-shaped pressure-receiving portion 68 disposed in contact with the porous material 60 and a leaf spring portion 69 disposed in contact with the inner bottom portion of the supply port 56*a*. The pressure-receiving portion 68 includes a plurality of orifices 70.

When the cartridge 36 is at the engaged position, the annular projection 58 has an end portion in the front-back direction Y (right-hand end in FIG. 9) disposed in contact with the abutment portion 64 of the elastic member 53, as shown in FIG. 9. At this stage, the other end portion of the annular projection 58 in the front-back direction Y (left-hand end in FIG. 9) is spaced from the abutment portion 64 of the elastic member 53.

Figure 10:
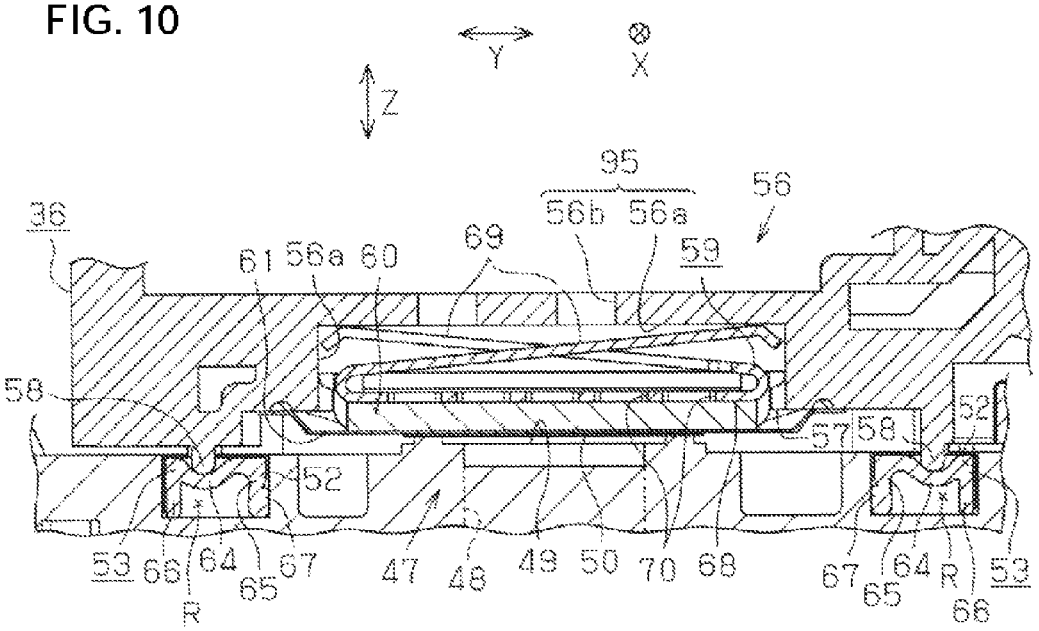
FIG. 10 is an enlarged cross-sectional view of a portion shown in FIG. 5.

When the cartridge 36 is made to pivot toward the mounted position, the lower face of the upstream filter 61 if the liquid supply unit 56 and the upper face of the downstream filter 50 of the liquid introduction path 47 are brought into contact with each other, as shown in FIG. 10. In addition, when the other end portion of the annular projection 58 (left-hand end in FIG. 10) is made to abut the abutment portion 64 of the elastic member 53, the abutment portion 64 pressed by the annular projection 58 is elastically deformed downward. Thus, the region around the joint portion between the upstream flow path 95 and the downstream flow path 48 is sealed by the elastic member 53.

Further, when the leaf spring portion 69 of the spring 59 is compressed by the pivotal motion of the cartridge 36, the porous material 60 is subjected to the biasing force of the spring 59 and horizontally diffuses the ink delivered through the communication hole 56*b*, thus supplying the ink toward the upstream filter 61. Then the ink transmitted through the upstream filter 61 and the downstream filter 50 is delivered toward the downstream flow path 48.

The liquid ejecting apparatus 12 configured as above provides the following advantageous effect.

As shown in FIG. 4, the mounting mechanism 37 includes the downstream flow path 48 having the downstream end communicating with the liquid ejecting head 33, and the engaging portion 54 extending in the front-back direction Y. In contrast, the cartridge 36 includes the upstream flow path 95 to be communicably connected to the downstream flow path 48 when the cartridge 36 is mounted on the mounting mechanism 37, the mating portion 55 to be engaged with the engaging portion 54, and the annular projection 58 projecting so as to surround the liquid outlet 57. With such configurations, the cartridge 36 is mounted on the mounting mechanism 37 as shown in FIG. 5, by being made to pivot about the mating portion 55 engaged with the engaging portion 54 of the mounting mechanism 37.

Therefore, the annular projection 58 of the cartridge 36, located at the engaged position indicated by dash-dot-dot lines in FIG. 8, is displaced in the front-back direction Y with the pivotal motion of the cartridge 36 to the position indicated by solid lines in FIG. 8, and made to abut the abutment portion 64 of the elastic member 53.

As stated above, in the abutment portion 64 of the elastic member 53 the first width W1 in the front-back direction Y is wider than the second width W2 in the main scanning direction X, and the width D1 in the front-back direction Y is wider than the width D2 in the main scanning direction X. Accordingly, the abutment portion 64 remains in contact with the annular projection 58 despite the annular projection 58 being displaced in the front-back direction Y. As a result, even though the cartridge 36 is mounted by being made to pivot, the joint portion between the upstream flow path 95 and the downstream flow path 48 can be securely sealed by the elastic member 53.

In particular, the liquid ejecting apparatus 12 receives the ink from the liquid tank 91, which is an external source, to thereby successively perform a larger amount of recording operations, and hence the cartridge 36 may remain attached to the mounting mechanism 37 for a long period of time without being removed. Accordingly, in the case where the joint portion between the upstream flow path 95 and the downstream flow path 48 is insufficiently sealed, a larger amount of ink leaks continuously. With the liquid ejecting apparatus 12 according to this embodiment, however, the joint portion can be securely sealed by the elastic member 53, and therefore the leakage of the ink can be effectively suppressed even when the recording operation is successively performed.

Further, with the reduced width D2 of the abutment portion 64 of the elastic member 53 in the main scanning direction X, the elastic member 53 is also applicable to a cartridge 36 having a shorter length in the main scanning direction X.

In addition, when the cartridge 36 is made to pivot from the engaged position toward the mounted position, the abutment portion 64 is flexurally deformed downward as shown in FIG. 10, because of the downward displacement of the annular projection 58. Further, with the flexural deformation of the abutment portion 64, air is squeezed out from the space R defined by the abutment portion 64, the support walls 65, 66, and the groove 52, and hence the space R is depressurized. Therefore, the elastic member 53 is adsorbed to the mounting mechanism 37.

Here, in the case where the cartridge 36 remains attached to the mounting mechanism 37 for a long period of time, the elastic member 53 may stick to the annular projection 58 and be separated from the mounting mechanism 37 when the cartridge 36 is removed. With the configuration according to this embodiment, however, the elastic member 53 is adsorbed to the mounting mechanism 37, and thus prevented from being separated from the mounting mechanism 37 when the cartridge 36 is removed.

Still further, since the press-contact portion 67 of the elastic member 53 is pressed against the inner wall of the groove 52, the separation of the elastic member 53 from the mounting mechanism 37 due to the removal of the cartridge 36 can be more securely prevented.

The foregoing embodiment provides the following advantageous effects.

The cartridge 36 is attached to the mounting mechanism 37 by being made to pivot about the mating portion 55 engaged with the engaging portion 54 of the mounting mechanism 37. Therefore, the upstream flow path 95 and the downstream flow path 48 can be connected with a reduced force. In addition, since the first width W1 of the abutment portion 64 is wider than the second width W2, the region around the liquid introduction path 49 can be securely sealed even when the annular projection 58 is shifted in the front-back direction Y by the pivotal motion of the cartridge 36 when entering in contact with the abutment portion 64. Therefore, a sufficient sealing effect of the joint portion in the liquid flow path can be secured, with a reduced force for connecting the liquid flow path.

Since the width D1 of the abutment portion 64 in the front-back direction Y is wider than the width D2 in the main scanning direction X, the region around the liquid introduction path 49 can be securely sealed even when the annular projection 58 is shifted in the front-back direction Y by the pivotal motion of the cartridge 36 when entering in contact with the abutment portion 64.

The abutment portion 64 is flexurally deformed downward upon being pressed by the annular projection 58, and therefore the region around the annular projection 58 can be securely sealed with a reduced counterforce originating from the elastic deformation of the abutment portion 64. In addition, the space R defined by the abutment portion 64 and the support walls 65, 66 is depressurized because the flexural deformation of the abutment portion 64 squeezes air out of the space R. Therefore, the elastic member 53 is adsorbed to the mounting mechanism 37 and resultantly the elastic member 53 can be prevented from being separated from the mounting mechanism 37 when the cartridge 36 is removed.

The reduced length L1 of the abutment portion 64 of the elastic member 53 in the up-down direction Z leads to reduced counterforce originating from the elastic deformation. In addition, making the length L2 of the support walls 65, 66 of the elastic member 53 in the up-down direction Z longer than the length L1 of the abutment portion 64 allows the space R for the downward flexural deformation of the abutment portion 64 to be secured.

The elastic member 53 has a symmetrical shape in both of the front-back direction Y and the main scanning direction X, and therefore the orientation of the elastic member 53 in the front-back direction Y or main scanning direction X is not limited when the elastic member 53 is attached to the mounting mechanism 37. Such a configuration facilitates the elastic member 53 to be set in place, compared with the case where the mounting orientation is limited in the front-back direction Y or main scanning direction X.

The foregoing embodiment may be modified as follows.

The engaging portion 54 of the mounting mechanism 37 may be formed in a protruding shape, and the mating portion 55 of the cartridge 36 may be formed in a recessed shape. Alternatively, the engaging portion 54 of the mounting mechanism 37 may be formed in a protruding shape and the mating portion 55 of the cartridge 36 may be formed in a protruding shape.

The shape or size of the elastic member 53 may be modified according to the shape of the liquid introduction path 49 or the annular projection 58. For example, in the elastic member 53 the width D1 of the abutment portion 64 in the front-back direction Y may be equal to, or narrower than, the width D2 in the main scanning direction X. Further, it is not mandatory that the elastic member 53 is symmetrical in the front-back direction Y or main scanning direction X.

In the elastic member 53, the length L1 of the abutment portion 64 in the up-down direction Z may be equal to, or longer than, the length L2 of the support walls 65, 66 in the up-down direction Z.

The elastic member 53 may further include a strip-shaped support portion under the abutment portion 64, the support portion having a first width and a second width respectively equal to the first width W1 and the second width W2 of the abutment portion 64. In this case also, the abutment portion 64 can be flexurally deformed by employing a material having higher elasticity than the abutment portion 64 for the support portion.

The shape, location, or number of the fasteners 92 and ducts 93 may be modified as desired. Alternatively, either or both of the fastener 92 and the duct 93 may be excluded.

A cutaway portion may be formed in the sidewall 13*a* of the main casing 13, to introduce the liquid supply tube 90 into the main casing 13 through the cutaway portion.

The routing of the liquid supply tube 90 may be modified as desired. For example, the liquid supply tube 90 may be routed along the rear side of the opening 35 on the upper wall 34.

A part of the liquid tank may be placed inside of the liquid ejecting apparatus, and another part may be located outside of the liquid ejecting apparatus.

The liquid tank 91 may be of a refillable type, or may be provided with a replaceable pack.

The liquid tank may be integrally fixed to the liquid ejecting apparatus, or located away from the liquid ejecting apparatus.

The medium may be a resin film, a metal plate, or a cloth, without limitation to the paper sheet.

The liquid ejecting apparatus according to the foregoing embodiments may be configured to eject or dispense a liquid other than the ink. The form of minute droplets dispensed from the liquid ejecting apparatus may be of a particle shape, a tear-drop shape, or a shape with a thread-like trailing tail. The term "liquid" herein referred to implies those that can be ejected from the liquid ejecting apparatus. For example, substances in the liquid phase may be employed, such as a fluid having high or low viscosity, a sol, a gel, an organic or inorganic solvent, a solution, a liquid resin, or a liquid metal (metal melt). Further, in addition to the substances in the liquid phase, a liquid containing, dispersed or dissolved, dispersed, or mixed therein, functional particles formed of a solid pigment or metal particles may be employed. The ink and the liquid crystal referred to above are typical examples of the liquid. Here, the term "ink" broadly implies, in addition to popular water-based ink and oil-based ink, various liquid compounds such as a gel ink and a hot-melt ink. Specific examples of the liquid ejecting apparatus include those that eject a liquid containing, dispersed or dissolved therein, an electrode material or a color material for manufacturing LCDs, electroluminescence displays, field emission displays, and color filters. Examples of the liquid ejecting apparatus further include those that eject a bioorganic substance for manufacturing biochips, those employed as a precision pipette that ejects a liquid that serves as a specimen, a printing machine, and a micro dispenser. In addition, the invention is also applicable to liquid ejecting apparatuses that eject a lubricant in a pinpoint manner to a precision instrument such as a watch or a camera, those that eject a clear resin fluid such as a UV-curable resin onto a substrate for manufacturing a micro hemispherical lens (optical lens) employed in an optical communication element, and those that eject an acid or alkali etching solution for etching of a substrate or the like.

The entire disclosure of Japanese Patent Application No. 2012-084633 filed on Apr. 3, 2012, and No. 2012-178155 filed on Aug. 10, 2012, are expressly incorporated by reference herein.

What is claimed is:

1. A liquid ejecting apparatus comprising:

a liquid ejecting head that ejects a liquid;

a carriage that reciprocates in a predetermined stroke region;

a liquid tank provided outside of the stroke region;

a mounting mechanism including a downstream flow path having a downstream end communicating with the liquid ejecting head;

an object to be mounted on the mounting mechanism, the object to be mounted including an annular projection formed so as to surround, when the object to be mounted is attached to the mounting mechanism, a liquid outlet to be communicably connected to the downstream flow path;

a liquid supply tube connected to the liquid tank; and an elastic member disposed to surround a liquid introduction path corresponding to an upstream end of the downstream flow path, the elastic member including an abutment portion, wherein the mounting mechanism includes an engaging portion extending in a first direction, and the object to be mounted includes a mating portion to be engaged with the engaging portion, so as to be mounted on the mounting mechanism by being made to pivot about the mating portion engaged with the engaging portion.

2. The liquid ejecting apparatus according to claim 1, wherein the elastic member has an annular shape with an outer diameter larger than an outer diameter of the annular projection and an inner diameter smaller than an inner diameter of the annular projection, and a first width of the abutment portion corresponding to a distance between an outer periphery and an inner periphery in the first direction is larger than a second width corresponding to a distance between an outer periphery and an inner periphery in a second direction intersecting the first direction.

3. The liquid ejecting apparatus according to claim 2, wherein the elastic member includes a pair of support walls respectively extending from the inner periphery and the outer periphery of the abutment portion in a third direction intersecting both the first direction and the second direction.

4. The liquid ejecting apparatus according to claim 3, wherein, in the elastic member, a length of the abutment portion in the third direction is shorter than a length of the support wall in the third direction.

5. The liquid ejecting apparatus according to claim 3, wherein the elastic member has a midpoint in the first direction coinciding with a midpoint in the second direction when viewed in a third direction intersecting both the first direction and the second direction, and has a line-symmetrical shape with respect to a first axis extending in the first direction through the midpoint, and with respect to a second axis extending in the second direction through the midpoint.

6. The liquid ejecting apparatus according to claim 2, wherein the elastic member has a midpoint in the first direction coinciding with a midpoint in the second direction when viewed in a third direction intersecting both the first direction and the second direction, and has a line-symmetrical shape with respect to a first axis extending in the first direction through the midpoint, and with respect to a second axis extending in the second direction through the midpoint.

7. The liquid ejecting apparatus according to claim 2, wherein the liquid tank is provided outside of the liquid ejecting apparatus.

8. The liquid ejecting apparatus according to claim 1, wherein a width of the abutment portion in the first direction is larger than a width thereof in a second direction.

9. The liquid ejecting apparatus according to claim 8, wherein the liquid tank is provided outside of the liquid ejecting apparatus.

10. The liquid ejecting apparatus according to claim 1, wherein the elastic member includes a pair of support walls respectively extending from an inner periphery and an outer periphery of the abutment portion in a third direction intersecting both the first direction and a second direction.

11. The liquid ejecting apparatus according to claim 10, wherein, in the elastic member, a length of the abutment portion in the third direction is shorter than a length of the support wall in the third direction.

12. The liquid ejecting apparatus according to claim 10, wherein the liquid tank is provided outside of the liquid ejecting apparatus.

13. The liquid ejecting apparatus according to claim 1, wherein the elastic member has a midpoint in the first direction coinciding with a midpoint in a second direction when viewed in a third direction intersecting both the first direction and the second direction, and has a line-symmetrical shape with respect to a first axis extending in the first direction through the midpoint, and with respect to a second axis extending in the second direction through the midpoint.

14. The liquid ejecting apparatus according to claim 1, wherein the liquid tank is provided outside of the liquid ejecting apparatus.

* * * * *